US011393394B2

(12) United States Patent
Xu et al.

(10) Patent No.: US 11,393,394 B2
(45) Date of Patent: Jul. 19, 2022

(54) COMPENSATION METHOD AND COMPENSATION APPARATUS FOR ORGANIC LIGHT-EMITTING DISPLAY AND DISPLAY DEVICE

(71) Applicants: BOE Technology Group Co., Ltd., Beijing (CN); Hefei Xinsheng Optoelectronics Technology Co., Ltd., Anhui (CN)

(72) Inventors: Haixia Xu, Beijing (CN); Song Meng, Beijing (CN); Yue Wu, Beijing (CN); Wenchao Bao, Beijing (CN); Min He, Beijing (CN)

(73) Assignees: BOE Technology Group Co., Ltd., Beijing (CN); Hefei Xinsheng Optoelectronics Technology Co., Ltd., Anhui (CN)

( * ) Notice: Subject to any disclaimer, the term of this patent is extended or adjusted under 35 U.S.C. 154(b) by 793 days.

(21) Appl. No.: 16/094,442

(22) PCT Filed: Mar. 1, 2018

(86) PCT No.: PCT/CN2018/077721

§ 371 (c)(1),
(2) Date: Oct. 17, 2018

(87) PCT Pub. No.: WO2018/205717

PCT Pub. Date: Nov. 15, 2018

(65) Prior Publication Data

US 2021/0225277 A1 Jul. 22, 2021

(30) Foreign Application Priority Data

May 12, 2017 (CN) ..... 201710333919.6

(51) Int. Cl.
*G09G 3/3233* (2016.01)

(52) U.S. Cl.
CPC ... *G09G 3/3233* (2013.01); *G09G 2300/0426* (2013.01); *G09G 2300/0819* (2013.01);
(Continued)

(58) Field of Classification Search
CPC ..... G09G 3/3233; G09G 2320/0295; G09G 2300/0819; G09G 2320/0233;
(Continued)

(56) References Cited

U.S. PATENT DOCUMENTS 8,659,519 B2 2/2014 Abe et al.
9,591,715 B2 3/2017 Gai et al.
(Continued)

FOREIGN PATENT DOCUMENTS

CN 102122486 A 7/2011
CN 103903559 A 7/2014
(Continued)

OTHER PUBLICATIONS

Dictionary.com, "adjacent," in Dictionary.com Unabridged. Source location: Random House, Inc. http://dictionary.reference.com/browse/adjacent, Nov. 18, 2011, p. 1.*
(Continued)

*Primary Examiner* — Jeff Piziali
(74) *Attorney, Agent, or Firm* — Banner & Witcoff, Ltd.

(57) ABSTRACT

A compensation method and a compensation apparatus for an organic light-emitting display, and a display device are disclosed. The compensation method includes: determining a write-back voltage of each sub-pixel to be compensated in a row to be compensated in a current frame according to a data voltage and a gain value of the sub-pixel to be compensated in the row to be compensated in the current frame, the gain value being greater than 1; and respectively writing back the write-back voltage of each sub-pixel to be compensated in the row to be compensated in the current frame
(Continued)

correspondingly to the sub-pixel to be compensated in the row to be compensated in scan time of a blank period of the current frame.

18 Claims, 3 Drawing Sheets

(52) U.S. Cl.
CPC ..... *G09G 2300/0842* (2013.01); *G09G 2320/0233* (2013.01); *G09G 2320/0295* (2013.01); *G09G 2360/16* (2013.01)

(58) Field of Classification Search
CPC ... G09G 2300/0842; G09G 2300/0426; G09G 2360/16
See application file for complete search history.

(56) References Cited

U.S. PATENT DOCUMENTS

| | | | | |
|---|---|---|---|---|
| 9,734,800 | B2 | 8/2017 | Han et al. | |
| 2008/0238833 | A1* | 10/2008 | Hioki | G09G 3/3233 345/76 |
| 2008/0303754 | A1* | 12/2008 | Murata | G09G 3/3233 345/76 |
| 2009/0066614 | A1* | 3/2009 | Ishii | G09G 3/3275 345/76 |
| 2009/0174628 | A1 | 7/2009 | Wang et al. | |
| 2011/0074757 | A1 | 3/2011 | Chung et al. | |
| 2011/0164010 | A1 | 7/2011 | Yamamoto et al. | |
| 2014/0176400 | A1 | 6/2014 | Park et al. | |
| 2015/0123953 | A1 | 5/2015 | Shim et al. | |
| 2015/0187259 | A1* | 7/2015 | Jeong | G09G 3/3233 345/690 |
| 2015/0187267 | A1* | 7/2015 | Park | G09G 3/3233 345/77 |
| 2016/0189617 | A1* | 6/2016 | Park | G09G 5/10 345/690 |
| 2016/0210900 | A1 | 7/2016 | Kim | |
| 2017/0004765 | A1* | 1/2017 | Tani | G09G 3/3233 |
| 2017/0132977 | A1 | 5/2017 | Kim | |

FOREIGN PATENT DOCUMENTS

| | | | |
|---|---|---|---|
| CN | 104658485 | A | 5/2015 |
| CN | 105243985 | A | 1/2016 |
| CN | 106920516 | A | 7/2017 |
| KR | 1020160093179 | A | 8/2016 |

OTHER PUBLICATIONS

May 18, 2018—(WO) International Search Report and the Written Opinion Appn PCT/CN2018/077721 with English Translation.
Sep. 18, 2020—(EP) Extended European Search Report Appn 18797939.8.
Jun. 11, 2021—(IN) Office Action Appn 201947034043.
Oct. 11, 2021—(JP) Office Action Appn 2019-554662.
Mar. 28, 2022—(JP) Final Office Action Appn 2019-554662.

* cited by examiner

COMPENSATION METHOD AND COMPENSATION APPARATUS FOR ORGANIC LIGHT-EMITTING DISPLAY AND DISPLAY DEVICE

The application is a U.S. National Phase Entry of International Application No. PCT/CN2018/077721 filed on Mar. 1, 2018, designating the United States of America and claiming priority to Chinese Patent Application No. 201710333919.6, filed on May 12, 2017. The present application claims priority to and the benefit of the above-identified applications and the above-identified applications are incorporated by reference herein in their entirety.

TECHNICAL FIELD

Embodiments of the present disclosure relate to a compensation method and a compensation apparatus for an organic light-emitting display (OLED), and a display device.

BACKGROUND

An Active-Matrix Organic Light-Emitting Display (AMOLED), as a current-type light-emitting component, is more and more widely applied to high-performance display. Due to the self-illumination characteristic, the AMOLED, as compared to a liquid crystal display (LCD), has various advantages such as high contrast, ultra-thin performance, bendability and the like.

Under the long-time pressurization and high-temperature conditions, a threshold voltage of a thin film transistor (TFT) in the AMOLED may be drifted. Due to different display images, written data voltages are different, and threshold drift amounts of drive thin film transistors of respective portions of an AMOLED panel are different, which may cause a difference in display brightness, because such difference is related to an image displayed before a current frame of image, and thus, it is generally shown as an afterimage phenomenon, i.e., a so-called afterimage.

At present, in order to solve the afterimage problem, besides improvement of a process, a compensation technology can also be used. Currently, there is a method for detecting electrical characteristics of a pixel by a drive chip and then performing compensation. In such compensation method, a sense circuit of the drive chip extracts an electrical signal of the drive thin film transistor of the pixel, a compensation voltage value which needs to be compensated is determined by means of an integrated circuit chip, and the compensation voltage value is fed back to the drive chip so as to implement compensation.

In order to implement detection on the electrical signal, generally, last several rows of scan time of one frame of image will be used as scan time of a blank period in the AMOLED. Because no pixel is arranged in the blank period, the electrical signal can be detected and the compensation voltage value can be determined in the scan time of the blank period. In display time of each frame image, the electrical signals of the drive thin film transistors of a certain row of pixels can be detected. In order to perform detection on the electrical signal of the drive thin film transistor, generally, a sense line is connected between the drive thin film transistor and an OLED device, and a sense thin film transistor is arranged between the sense line and the drive thin film transistor. In the scan time of the blank period, the sense thin film transistor is turned on, and at the moment, a current flowing to the OLED device will flow to the sense line, resulting in that the OLED device will be darkened, i.e., a dark line appears in the row of pixels.

SUMMARY

At least one embodiment of the present disclosure provides a compensation method for an organic light-emitting display (OLED), the compensation method comprises: determining a write-back voltage of each sub-pixel to be compensated in a row to be compensated in a current frame according to a data voltage and a gain value of the sub-pixel to be compensated in the row to be compensated in the current frame, the gain value being greater than 1; and respectively writing back the write-back voltage of each sub-pixel to be compensated in the row to be compensated in the current frame correspondingly to the sub-pixel to be compensated in the row to be compensated in scan time of a blank period of the current frame.

For example, in an implementation manner of the compensation method according to an embodiment of the present disclosure, display time of the current frame comprises a plurality of row scan time periods, the scan time of the blank period comprises last W1 row scan time periods in the plurality of row scan time periods, and the last W1 row scan time periods comprise a charge phase and a compensation write-back phase, wherein W1 is a positive integer, the compensation method comprises: in the charge phase, charging a sense line corresponding to each sub-pixel to be compensated in the row to be compensated, the sense line being used for detecting an electrical signal of the sub-pixel to be compensated; and in the compensation write-back phase, calculating a compensation voltage of each sub-pixel to be compensated in the row to be compensated in a next frame adjacent to the current frame according to the detected electrical signal of the sense line.

For example, in another implementation manner of the compensation method according to an embodiment of the present disclosure, the compensation method further comprises: in the compensation write-back phase, respectively writing back the write-back voltage of each sub-pixel to be compensated in the row to be compensated in the current frame correspondingly to the sub-pixel to be compensated in the row to be compensated.

For example, in another implementation manner of the compensation method according to an embodiment of the present disclosure, determining the write-back voltage of each sub-pixel to be compensated in the row to be compensated in the current frame according to the data voltage and the gain value of the sub-pixel to be compensated in the row to be compensated in the current frame comprises: acquiring the gain value of each sub-pixel to be compensated; and respectively multiplying the data voltage of each sub-pixel to be compensated in the current frame by the gain value to obtain the write-back voltage of each sub-pixel to be compensated in the current frame.

For example, in another implementation manner of the compensation method according to an embodiment of the present disclosure, the gain value is determined by adopting a formula: $A=M/(M-N)$, A represents the gain value of the sub-pixel to be compensated in the row to be compensated, M represents a quantity of the plurality of row scan time periods included in the display time of the current frame, and N represents a quantity of row scan time periods included in the charge phase.

For example, in another implementation manner of the compensation method according to an embodiment of the present disclosure, all sub-pixels to be compensated in the row to be compensated work in a same color.

For example, in another implementation manner of the compensation method according to an embodiment of the present disclosure, the gain value of the sub-pixel to be compensated in the row to be compensated corresponds to a color corresponding to the sub-pixel to be compensated.

For example, in another implementation manner of the compensation method according to an embodiment of the present disclosure, the sub-pixel to be compensated comprises a pixel circuit, the pixel circuit comprises a drive transistor, a data writing transistor and a sense transistor, the compensation write-back phase comprises a write-back sub-phase and a re-light-emitting sub-phase, and respectively writing back the write-back voltage of each sub-pixel to be compensated in the row to be compensated in the current frame correspondingly to the sub-pixel to be compensated in the row to be compensated comprises: when the charge phase is completed, resetting a voltage of the sense line; in the write-back sub-phase, controlling the data writing transistor of each sub-pixel to be compensated in the row to be compensated to be turned on, and writing the write-back voltage into a gate electrode of the drive transistor of each sub-pixel to be compensated in the row to be compensated; and in the re-light-emitting sub-phase, controlling the data writing transistor of each sub-pixel to be compensated in the row to be compensated to be turned off, and controlling the sense transistor of each sub-pixel to be compensated in the row to be compensated to be turned off.

For example, in another implementation manner of the compensation method according to an embodiment of the present disclosure, in the sub-pixel to be compensated in the row to be compensated, a drive signal of the data writing transistor and a drive signal of the sense transistor are a same signal.

An embodiment of the present disclosure further provides a compensation apparatus for an organic light-emitting display, and the compensation apparatus comprises: a write-back determination circuit, configured to determine a write-back voltage of each sub-pixel to be compensated in a row to be compensated in a current frame according to a data voltage and a gain value of the sub-pixel to be compensated in the row to be compensated in the current frame, the gain value being greater than 1; and a write-back compensation circuit, configured to respectively write back the write-back voltage of each sub-pixel to be compensated in the row to be compensated in the current frame correspondingly to the sub-pixel to be compensated in the row to be compensated in scan time of a blank period of the current frame.

For example, in an implementation manner of the compensation apparatus according to an embodiment of the present disclosure, display time of the current frame comprises a plurality of row scan time periods, the scan time of the blank period comprises last W1 row scan time periods in the plurality of row scan time periods, and the last W1 row scan time periods comprise a charge phase and a compensation write-back phase, wherein W1 is a positive integer, and the write-back compensation circuit is configured to: in the charge phase, charge a sense line corresponding to each sub-pixel to be compensated in the row to be compensated, the sense line being used for detecting an electrical signal of the sub-pixel to be compensated; and in the compensation write-back phase, calculate a compensation voltage of each sub-pixel to be compensated in the row to be compensated in a next frame adjacent to the current frame according to the detected electrical signal of the sense line.

For example, in another implementation manner of the compensation apparatus according to an embodiment of the present disclosure, the write-back compensation circuit is further configured to: in the compensation write-back phase, respectively write back the write-back voltage of each sub-pixel to be compensated in the row to be compensated in the current frame correspondingly to the sub-pixel to be compensated in the row to be compensated.

For example, in another implementation manner of the compensation apparatus according to an embodiment of the present disclosure, the write-back determination circuit is configured to: acquire the gain value of each sub-pixel to be compensated; and respectively multiply the data voltage of each sub-pixel to be compensated in the current frame by the gain value to obtain the write-back voltage of each sub-pixel to be compensated in the current frame.

For example, in another implementation manner of the compensation apparatus according to an embodiment of the present disclosure, the gain value is determined by adopting a formula: $A=M/(M-N)$, A represents the gain value of the sub-pixel to be compensated in the row to be compensated, M represents a quantity of the plurality of row scan time periods included in the display time of the current frame, and N represents a quantity of row scan time periods included in the charge phase.

For example, in another implementation manner of the compensation apparatus according to an embodiment of the present disclosure, the sub-pixel to be compensated comprises a pixel circuit and a light-emitting component, the pixel circuit comprises a drive transistor, a data writing transistor, a sense transistor and a capacitor, and the drive transistor is configured to drive the light-emitting component to emit light; the data writing transistor is configured to write the data voltage into a gate electrode of the drive transistor when the data writing transistor is turned on; the capacitor is configured to store the data voltage and maintain the data voltage at the gate electrode of the drive transistor; and the sense transistor is configured to charge the sense line corresponding to the sub-pixel to be compensated.

For example, in another implementation manner of the compensation apparatus according to an embodiment of the present disclosure, the compensation write-back phase comprises a write-back sub-phase and a re-light-emitting sub-phase, and the write-back compensation circuit is configured to: when the charge phase is completed, reset a voltage of the sense line; in the write-back sub-phase, control the data writing transistor of each sub-pixel to be compensated in the row to be compensated to be turned on, and write the write-back voltage into the gate electrode of the drive transistor of each sub-pixel to be compensated in the row to be compensated; and in the re-light-emitting sub-phase, control the data writing transistor of each sub-pixel to be compensated in the row to be compensated to be turned off, and control the sense transistor of each sub-pixel to be compensated in the row to be compensated to be turned off.

For example, in another implementation manner of the compensation apparatus according to an embodiment of the present disclosure, a source electrode of the data writing transistor is configured to receive the data voltage, a gate electrode of the data writing transistor is connected with a gate line to receive a first drive signal, and a drain electrode of the data writing transistor is connected with the gate electrode of the drive transistor; a source electrode of the drive transistor is connected with a first power supply end, and a drain electrode of the drive transistor is connected with a first end of the light-emitting component; an end of the capacitor is connected with the gate electrode of the drive transistor, and the other end of the capacitor is connected with the drain electrode of the drive transistor; and a source electrode of the sense transistor is connected with the drain electrode of the drive transistor, a drain electrode of the sense transistor is connected with the sense line corresponding to the sub-pixel to be compensated, and a gate electrode of the sense transistor is configured to receive a second drive signal.

For example, in another implementation manner of the compensation apparatus according to an embodiment of the present disclosure, in the sub-pixel to be compensated in the row to be compensated, the first drive signal and the second drive signal are a same signal.

For example, in another implementation manner of the compensation apparatus according to an embodiment of the present disclosure, all sub-pixels to be compensated in the row to be compensated work in a same color.

For example, in another implementation manner of the compensation apparatus according to an embodiment of the present disclosure, the gain value of the sub-pixel to be compensated in the row to be compensated corresponds to a color corresponding to the sub-pixel to be compensated.

An embodiment of the present disclosure further provides an organic electroluminescent display panel, and the organic electroluminescent display panel comprises any one of the above described compensation apparatuses.

An embodiment of the present disclosure further provides a display device, and the display device comprises any one of the above described compensation apparatuses.

BRIEF DESCRIPTION OF THE DRAWINGS

In order to clearly illustrate the technical solutions of the embodiments of the disclosure, the drawings of the embodiments will be briefly described in the following; it is obvious that the described drawings are only related to some embodiments of the disclosure and thus are not limitative to the disclosure.

DETAILED DESCRIPTION

In order to make objects, technical solutions and advantages of the embodiments of the present disclosure, the technical solutions of the embodiments of the present disclosure will be described in a clearly and fully understandable way in connection with the drawings related to the embodiments of the present disclosure.

Figure 1A:
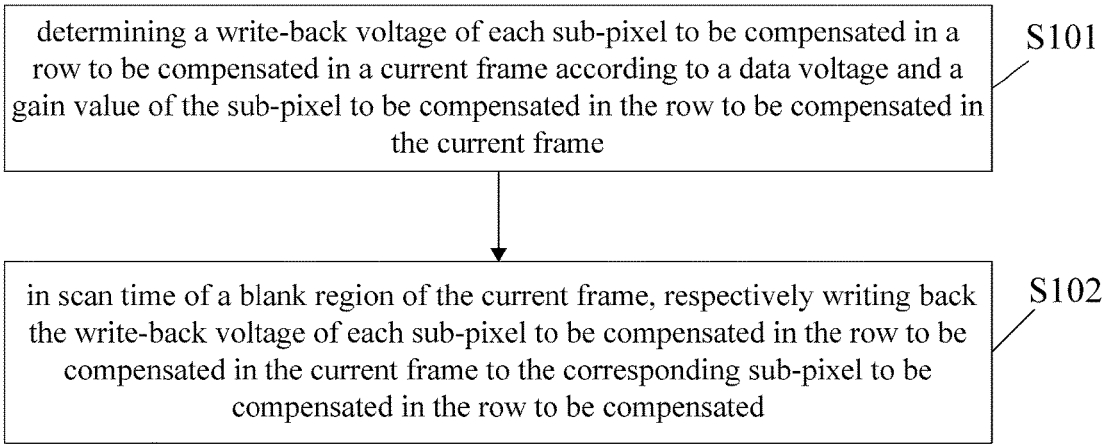
FIG. 1A is a flow chart of a compensation method for an OLED provided by an embodiment of the present disclosure.
Figure 1B:
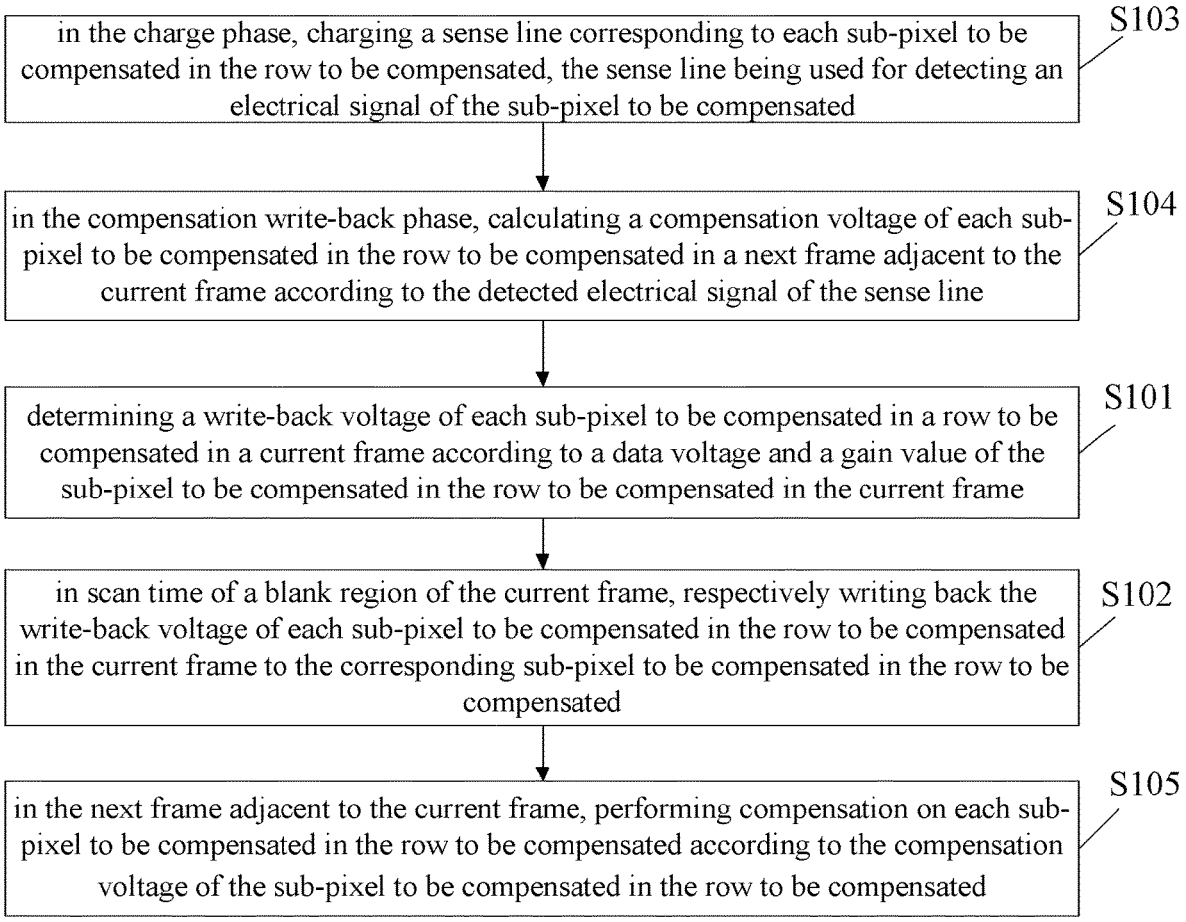
FIG. 1B is a flow chart of another compensation method for an OLED provided by an embodiment of the present disclosure.

FIG. 1A is a flow chart of a compensation method for an OLED provided by an embodiment of the present disclosure, FIG. 1B is a flow chart of another compensation method for an OLED provided by an embodiment of the present disclosure.

For example, referring to FIG. 1A, the compensation method comprises following steps:

Step S101, determining a write-back voltage of each sub-pixel to be compensated in a row to be compensated in a current frame according to a data voltage and a gain value of the sub-pixel to be compensated in the row to be compensated in the current frame; and Step S102: in scan time of a blank period of the current frame, respectively writing back the write-back voltage of each sub-pixel to be compensated in the row to be compensated in the current frame correspondingly to the sub-pixel to be compensated in the row to be compensated.

For example, any one frame of time may be equally divided into a plurality of row scan time periods, and scan time of a blank period includes last W1 row scan time periods in the plurality of row scan time periods. In order to facilitate understanding, firstly, the meaning of the blank period will be simply illustrated below: display time of an OLED panel with an external compensation function is generally divided into a period corresponding to a display region and the blank period, and the display region refers to a region in which pixels (units) are arranged and which are used for emitting light. But no pixel corresponds to the blank period, in the blank period; the pixels do not emit light. The blank period is mainly used for performing external compensation, and thus, a drive circuit may correspond to the blank period. Although no pixel corresponds to the blank period, in order to perform external compensation, part of scan time of one frame time may be allocated to the blank period, and the scan time allocated to the blank period is scan time of the blank period. The scan time of the blank period is used to implement to detect an electrical signal of a pixel in a row to be compensated and calculating a compensation voltage.

For example, one frame of time may be equally divided into M portions, each of the M portions is scan time of pixels in one row, the OLED panel may include a rows of pixels, and the a rows of pixels may be scanned in a progressive scanning mode. First a portions in one frame of time are scan time of a rows of pixels in the display region, and the last b portions in one frame of time are scan time of the blank period. a+b=M, where a, b and M are all positive integers, and a is greater than b. It should be noted that one frame of time indicates display time of one frame of image.

For example, display time of a current frame includes a plurality of row scan time periods, scan time of the blank period includes the last W1 row scan time periods of the plurality of row scan time periods, and the last W1 row scan time periods include a charge phase and a compensation write-back phase. For example, one frame of time may be divided into 2250 portions, the first 2160 portions correspond to scan time of 2160 rows of pixels in the display region, and the last 90 portions are scan time of the blank period and used for detecting electrical signals of pixels in the row to be compensated (i.e., the charge phase) and calculating compensation voltages (i.e., the compensation write-back phase).

For example, as shown in FIG. 1B, in some examples, the compensation method may further comprise:

Step S103: in the charge phase, charging a sense line corresponding to each sub-pixel to be compensated in the row to be compensated, the sense line being used for detecting an electrical signal of the sub-pixel to be compensated; and Step S104: in the compensation write-back phase, calculating a compensation voltage of each sub-pixel to be compensated in the row to be compensated in a next frame adjacent to the current frame according to the detected electrical signal of the sense line.

For example, in embodiments of the present disclosure, in the step S103, detecting the electrical signal of the sub-pixel to be compensated in the row to be compensated generally includes: detecting a voltage value of the sense line.

For example, the sense line is connected to a node between a drive transistor and a light-emitting component in the sub-pixel to be compensated, and a sense transistor is arranged between the sense line and the drive transistor. In the scan time of the blank period, the sense transistor is turned on, at the moment, a current originally flowing to the light-emitting component will flow to the sense line, and an integrated circuit chip connected with the sense line implements to detect the voltage value of the sense line, i.e., the electrical signal of a pixel of the row to be compensated is obtained.

It should be noted that a sequence of respective steps in FIG. 1A and FIG. 1B does not represent an operation sequence when the compensation method is performed. For example, the step S103, the step S104 and the step S102 are all performed in the scan time of the blank period.

An arrangement mode of the sense line will be illustrated below in conjunction with a structure diagram of a pixel circuit of the sub-pixel to be compensated in FIG. 2.

Figure 2:
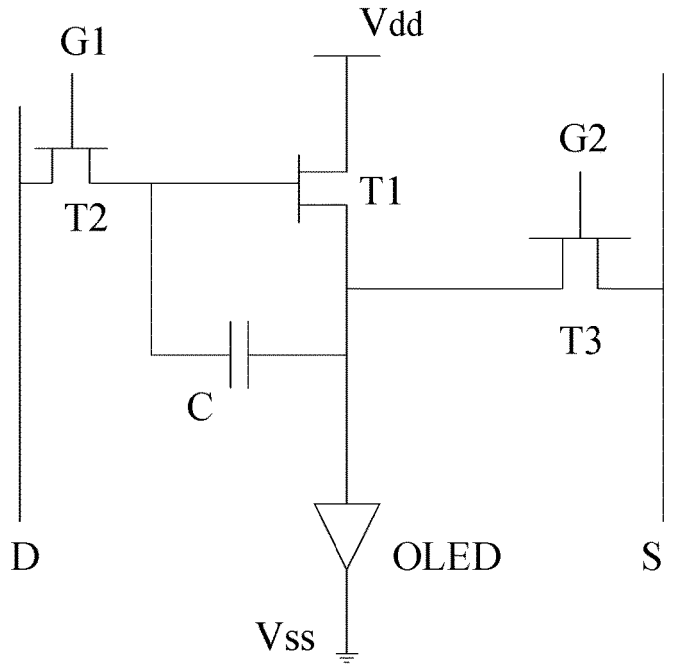
FIG. 2 is a structure diagram of a pixel circuit of a sub-pixel to be compensated provided by an embodiment of the present disclosure.

For example, as shown in FIG. 2, the sub-pixel to be compensated includes a pixel circuit and a light-emitting component OLED. The pixel circuit of the sub-pixel to be compensated may include a drive transistor T1, a data writing transistor T2, a capacitor C and a sense transistor T3. The drive transistor T1 is configured to drive the light-emitting component OLED to emit light; the data writing transistor T2 is configured to write a data voltage into a gate electrode of the drive transistor T1 when the data writing transistor is turned on; the capacitor C is configured to store the data voltage and maintain the data voltage at the gate electrode of the drive transistor T1; and the sense transistor T3 is configured to charge the sense line corresponding to the sub-pixel to be compensated.

For example, a source electrode of the data writing transistor T2 is connected with a data line D to receive the data voltage, a gate electrode of the data writing transistor T2 is connected with a gate line G1 to receive a first drive signal, and a drain electrode of the data writing transistor T2 is connected with the gate electrode of the drive transistor T1. A source electrode of the drive transistor T1 is connected with a first power supply end Vdd, a drain electrode of the drive transistor T1 is connected with a first end of the light-emitting component OLED, and a second end of the light-emitting component OLED is connected with a second power supply end Vss. An end of the capacitor C is connected with the gate electrode of the drive transistor T1, and the other end of the capacitor C is connected with the drain electrode of the drive transistor T1. A source electrode of the sense transistor T3 is connected with the drain electrode of the drive transistor T1 and the first end of the light-emitting component OLED, i.e., the source electrode of the sense transistor T3 is connected between the drain electrode of the drive transistor T1 and the first end of the light-emitting component OLED, a drain electrode of the sense transistor T3 is connected with the sense line S, and a gate electrode of the sense transistor T3 is connected with a control line G2 to receive a second drive signal.

Figure 3:
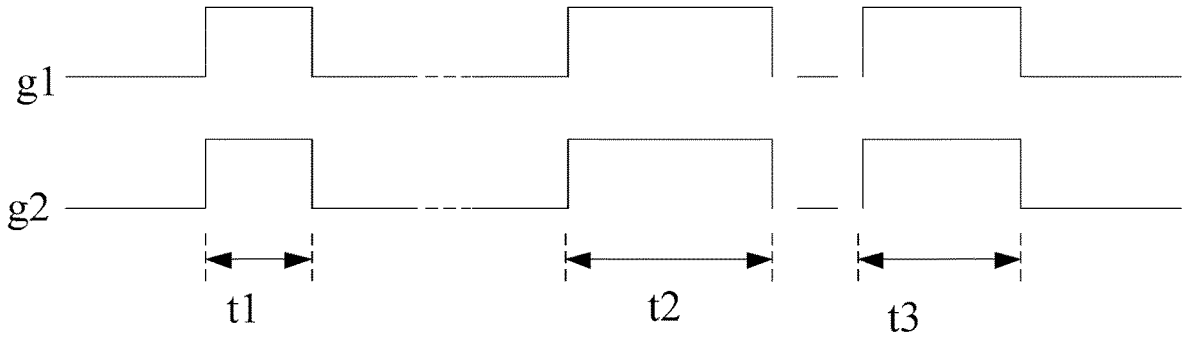
FIG. 3 is a timing diagram provided by an embodiment of the present disclosure.

FIG. 3 is a timing diagram of the pixel circuit structure shown in FIG. 2. A signal g1 is a control signal of the data writing transistor T2, i.e., the first drive signal provided by the gate line G1. A signal g2 is a control signal of the sense transistor T3, i.e., the second drive signal provided by the control line G2. As shown in FIG. 3, in the sub-pixel to be compensated provided by an embodiment of the present disclosure, the first drive signal g1 and the second drive signal g2 may be the same signal so as to facilitate the design of the pixel circuit.

For example, with reference to FIG. 3, in scan time t1 (i.e., a data writing phase of pixels of a row to be compensated) of the pixels of the row to be compensated, the gate line G1 provides a turn-on signal for the data writing transistor T2 so as to control the data writing transistor T2 to be turned on, and at this situation, the data line D writes the data voltage into the gate electrode of the drive transistor T1 and charges the capacitor C. In the data writing phase t1, the drive transistor T1 is not turned on, and thus, the integrated circuit chip does not detect the voltage value on the sense line S. In a light-emitting phase, both the data writing transistor T2 and the sense transistor T3 are in a turn-off state, the integrated circuit chip does not detect the voltage value on the sense line S, at this time, the drive transistor T1 is turned on, and the light-emitting component OLED emits light. In the charge phase t2 in the scan time of the blank period, both the drive transistor T1 and the sense transistor T3 are in a turn-on state, the current originally flowing via the drive transistor T1 to the light-emitting component OLED will flow to the sense line S to charge the sense line S, i.e., at the moment, the sense line S is in a charged state, resulting in that the light-emitting component OLED does not emit light.

The structure of the pixel circuit of the sub-pixel to be compensated shown in FIG. 2 is 2T1C. However, the structure of the pixel circuit of the sub-pixel to be compensated in the embodiments of the present disclosure is not limited to 2T1C, the pixel circuit may also be provided with more or fewer transistors and capacitors, and for example, the pixel circuit may also have a 5T1C or 7T1C structure.

For example, in the embodiments of the present disclosure, the driver transistor T1, the data writing transistor T2 and the sense transistor T3 may be thin film transistors, field effect transistors or other switching devices with the like characteristics. The thin film transistors may comprise polysilicon (low temperature polysilicon or high temperature polysilicon) thin film transistors, amorphous silicon thin film transistors, oxide thin film transistors, organic thin film transistors, or the like.

For example, the transistors may be classified into N-type transistors and P-type transistors according to the characteristics of the transistors. In the embodiments of the present disclosure, the technical solutions of the present disclosure are described in detail by taking a case, that the drive transistor T1, the data writing transistor T2 and the sense transistor T3 all are N-type transistors, as an example. However, the embodiments of the present disclosure are not limited thereto, and those skilled in the art can specifically set the types of the transistors according to actual needs. In the embodiments of the present disclosure, the source electrode and the drain electrode of all or part of the transistors in the embodiments of the present disclosure are interchangeable as needed.

It should be noted that on the OLED panel, one sense line may be provided for one pixel, the sense line is simultaneously connected with all the sub-pixels in one pixel, and in time of each frame, the sense line only conducts with one sub-pixel in the pixel, so that the sense line may be charged by one sub-pixel in the pixel and detect the electrical signal of one sub-pixel in the pixel. Other sub-pixels in the pixel are detected when the pixel row where the pixel is located is detected next time, and in other words, the sense line may detect one sub-pixel with one color in the pixel each time and compensate for the sub-pixel. Each pixel in the OLED panel generally includes four sub-pixels (red, green, blue and white) or three sub-pixels (red, green and blue).

It should be noted that the embodiments of the present disclosure are not limited to a case of providing one sense line for one pixel, and for example, two or more sense lines may also be provided for one pixel, so as to perform the detection and compensation processing on sub-pixels of two or more colors in the pixels simultaneously.

For example, the scan time of the blank period includes the last W1 row scan time periods in the plurality of row scan time periods. When electrical signal detection is performed, the first W11 row scan time periods in the scan time of the blank period are used to achieve to detect the electrical signal and the last W12 row scan time periods are used to achieve to determine the compensation voltage. For example, W11+W12=W1, both W11 and W12 are integers, and a time length of the first W11 row scan time periods is greater than that of the last W12 row scan time periods, i.e., W11 is greater than W12.

For example, if the scan time of the blank period comprises 90 portions, the first 70 portions are used for detecting the electrical signal, and the last 20 portions are used for determining the compensation voltage.

For example, in the step S103, detecting the electrical signal of the sub-pixel to be compensated may include: when detecting the electrical signal, firstly, determining a row number of a row where the sub-pixel to be compensated is positioned, i.e., a row number of the row to be compensated, and then controlling a sense transistor T3 of the row to be compensated to be turned on so as to implement to detect the electrical signal of the sense line.

For example, detecting the electrical signal of the sub-pixel to be compensated further includes: when the sense transistor T3 of the row to be compensated is controlled to be turned on, controlling sense transistors T3 of other rows to be kept in a turn-off state so as to implement electrical signal detection on one row of pixels in the scan time of each frame.

For example, in the embodiment of the present disclosure, the compensation write-back phase may include a compensation voltage calculation sub-phase. The step S104 includes: in the compensation voltage calculation sub-phase, calculating the compensation voltage of each sub-pixel to be compensated in the row to be compensated in a next frame adjacent to the current frame according to the detected electrical signal of the sense line. For example, in some examples, in the compensation voltage calculation sub-phase, the compensation voltage corresponding to the electrical signal of each sub-pixel to be compensated in the row to be compensated is determined according to the detected electrical signal of each sub-pixel to be compensated in the row to be compensated and a set signal of each sub-pixel to be compensated in the row to be compensated in the current frame.

For example, the electrical signal of each sub-pixel to be compensated in the row to be compensated is a detected voltage value of the sense line corresponding to each sub-pixel to be compensated in the row to be compensated in the current frame. The set signal of each sub-pixel to be compensated in the row to be compensated in the current frame is a set voltage of the sense line corresponding to each sub-pixel to be compensated in the row to be compensated in the current frame, and the set voltage corresponds to target brightness of the sub-pixel to be compensated in the current frame. The set voltage of the sense line corresponding to each sub-pixel to be compensated in the row to be compensated in the current frame may be obtained according to the data voltage written into each sub-pixel to be compensated in the row to be compensated in the current frame.

For example, the data voltage written into each sub-pixel to be compensated in the row to be compensated in the current frame corresponds to the target brightness of the sub-pixel to be compensated in the current frame, and thus, the set voltage of the sense line corresponding to each sub-pixel to be compensated in the row to be compensated in the current frame may be determined in a mode as follows: the target brightness of each sub-pixel to be compensated in the row to be compensated in the current frame is obtained according to the data voltage written into each sub-pixel to be compensated in the row to be compensated in the current frame, and the set voltage of the sense line corresponding to each sub-pixel to be compensated in the row to be compensated in the current frame is obtained according to the target brightness of each sub-pixel to be compensated in the row to be compensated in the current frame and a corresponding relationship between the target brightness and the set voltage of the sense line. It should be noted that the corresponding relationship between the target brightness and the set voltage of the sense line may be obtained in advance by a pre-detection method (for example, an experimental detection method).

For example, after the set voltage of the sense line corresponding to each sub-pixel to be compensated in the row to be compensated in the current frame is determined, in the compensation voltage calculation sub-phase, a difference between the detected voltage value of the sense line corresponding to each sub-pixel to be compensated in the current frame and the set voltage of the sense line corresponding to each sub-pixel to be compensated in the current frame is calculated, and the compensation voltage is determined based on the difference. For example, in some examples, in the compensation voltage calculation sub-phase, after the difference is calculated, a plurality of difference ranges corresponding to the difference are determined, and the compensation voltage corresponding to the difference is calculated according to a corresponding relationship of the plurality of difference ranges and the compensation voltage.

For example, the difference ranges are divided according to multiple of a set value A, and comprise such as (0, A], (A, 2A], . . . . A compensation voltage corresponding to a first difference range is a voltage value when a gray scale is 1, a compensation voltage corresponding to a second difference range is a voltage value when the gray scale is 2, and so on. After an absolute value of the compensation voltage is determined according to the above-mentioned corresponding relationship, it is determined that the compensation voltage positive or negative; when the detected voltage value of the sense line in the current frame is smaller than the set voltage, the compensation voltage is positive; and when the detected voltage value of the sense line in the current frame is greater than the set value, the compensation voltage is negative. The voltage values corresponding to respective difference ranges are only examples, and the respective difference ranges may also be set according to other voltage values in practice.

It should be noted that in the present disclosure, a specific setting mode of the above-mentioned set value A is not limited, and for example, the set value A may be 0.1V, and then the difference ranges may comprise (0V, 0.1V], (0.1V, 0.2V] . . . .

For example, in the step S103, the electrical signals of the sub-pixels to be compensated in one pixel row are simultaneously detected, and when the compensation voltages are determined, a compensation voltage corresponding to the electrical signal and the data voltage of each sub-pixel to be compensated needs to be respectively determined.

For example, the step S102 may include: in the compensation write-back phase, respectively writing back the write-back voltage of each sub-pixel to be compensated in the row to be compensated in the current frame correspondingly to the sub-pixel to be compensated in the row to be compensated.

For example, the compensation write-back phase may further include a write-back sub-phase and a re-light-emitting sub-phase. For example, the write-back sub-phase is the first several row scan time periods of the compensation write-back phase, and the re-light-emitting sub-phase is the last several row scan time periods of the compensation write-back phase.

It should be noted that the compensation voltage calculation sub-phase may be performed in parallel to the write-back sub-phase and the re-light-emitting sub-phase. In other words, the compensation voltage calculation sub-phase may be the first several row scan time periods and/or the last several row scan time periods of the compensation write-back phase.

For example, as shown in FIG. 2, in the write-back sub-phase, because the sense transistor is turned on, so that the sense line and the drive transistor are connected, and thus, the light-emitting component OLED does not emit light. The write-back sub-phase occupies short time and generally occupies 2 to 3 row scan time periods, so that the dark line lasts for the shortest time.

For example, the step S102 may include: when the charge phase is completed, resetting a voltage of the sense line (setting the voltage on the sense line to 0); in the write-back sub-phase, controlling the data writing transistor (i.e., T2 in FIG. 3) of the sub-pixel to be compensated in the row to be compensated to be turned on, and writing the voltage to be written back into the gate electrode of the drive transistor (i.e., T1 in FIG. 3) of each sub-pixel to be compensated in the row to be compensated; and in the re-light-emitting sub-phase, controlling the data writing transistor of the sub-pixel to be compensated in the row to be compensated to be turned off, and controlling the sense transistor (i.e., T3 in FIG. 3) of each sub-pixel to be compensated in the row to be compensated to be turned off.

For example, when the charge phase is completed, the voltage of the sense line is reset, meanwhile, the sense line is in a set state, and the sense line cannot be charged, so that when compensation is performed next time, the sense line can be normally charged.

For example, in the sub-pixel to be compensated in the row to be compensated, a drive signal (i.e., the first drive signal) of the data writing transistor and a drive signal (i.e., the second drive signal) of the sense transistor are the same signal, so as to facilitate design of the pixel circuit. Referring to FIG. 3, g1 and g2 respectively are the first drive signal and the second drive signal in the sub-pixel to be compensated.

For example, as shown in FIG. 2 and FIG. 3, after the charge phase t2, the data writing transistor T2 and the sense transistor T3 are in a turn-off state again, the voltage of the sense line is set to 0, so that the sense line is in the set state, and the sense line cannot be charged in the set state. In the first several row scan time periods t3 (i.e., the write-back sub-phase) of the compensation write-back phase of the current frame, the data writing transistor is turned on so as to achieve to write the write-back voltage into the gate electrode of the drive transistor of each sub-pixel to be compensated in the row to be compensated, and the write-back voltage at the moment is the write-back voltage calculated in the step S101. In the write-back sub-phase, i.e., when the write-back voltage is written in, because the sense transistor T3 is also in a turn-on state, the current flows to the sense line, and thus, the light-emitting component OLED does not emit light. After a process of writing in the write-back voltage is completed, i.e., in the re-light-emitting sub-phase, the data writing transistor T2 and the sense transistor T3 are turned off, the current passes through the light-emitting component OLED and drives the light-emitting component OLED to emit light, the write-back voltage written in again enables a gate electrode of the drive transistor T1 to be increased, and increase of the gate voltage of the drive transistor T1 causes a voltage difference between the gate electrode and the source electrode of the drive transistor T1 to be increased, so that the current of the drive transistor T1 is increased and light-emitting brightness of the light-emitting component OLED is increased, thereby achieving a function of eliminating the dark line on a display panel.

For example, as shown in FIG. 3, in the embodiment of the present disclosure, transient interval time can exist between the write-back sub-phase t3 and the charge phase t2 and for example, can be 1 to 2 row scan time periods, and the transient interval time can be used to achieve to switch a state of the sense line so as to avoid a case that when the write-back voltage is directly written in, the sense line continues to be in a charged state because the sense transistor T3 is turned on.

For example, as shown in FIG. 1B, the compensation method provided by the present disclosure further includes: step S105: in the next frame adjacent to the current frame, performing compensation on each sub-pixel to be compensated in the row to be compensated according to the compensation voltage of the sub-pixel to be compensated in the row to be compensated.

For example, in the embodiments of the present disclosure, the step S105 may include: calculating a sum of a data voltage and the compensation voltage of the sub-pixel to be compensated in the row to be compensated in the next frame adjacent to the current frame and using the sum as a final voltage of each pixel in the row to be compensated in the next frame adjacent to the current frame. In the next frame adjacent to the current frame, each pixel in the row to be compensated is charged according to the final voltage of each pixel in the row to be compensated.

For example, in the present disclosure, the data voltage of the next frame adjacent to the current frame refers to a data voltage written to sub-pixel to be compensated via the data line in the next frame adjacent to the current frame. In the next frame adjacent to the current frame, the data voltage of the sub-pixel to be compensated in the row to be compensated is provided by the drive circuit, and the data voltage is related to an image displayed by the next frame adjacent to the current frame.

For example, the step S101 may include:

Step S1011: acquiring the gain value of the sub-pixel to be compensated in the row to be compensated; and Step S1012: respectively multiplying the data voltage of each sub-pixel to be compensated in the row to be compensated in the current frame by the gain value to obtain the write-back voltage of the sub-pixel to be compensated in the row to be compensated in the current frame.

For example, in the step S101, the gain value is greater than 1. The gain value is a set value, that is, the gain value can be set in advance.

For example, in the step S101, colors corresponding to all sub-pixels to be compensated in the row to be compensated are the same. A color corresponding to the sub-pixel to be compensated is a color of light emitted by the sub-pixel to be compensated, and in order to facilitate description, in the description of the present disclosure below, a sub-pixel with a certain color also refers to a sub-pixel emitting light with the certain color.

For example, in some examples, the step S1011 may include: determining the number of the row scan time periods included in the charge phase of the scan time of the blank period of the current frame; and calculating the gain value of the sub-pixel to be compensated in the row to be compensated according to the determined number of the row scan time periods included in the charge phase.

For example, the gain value of the sub-pixel to be compensated in the row to be compensated can be determined by adopting a formula: $A=M/(M-N)$, where, A represents the gain value of the sub-pixel to be compensated in the row to be compensated, M represents the total row number, the total row number is equal to the number of the plurality of row scan time periods included in the display time of the current frame, and N can represent the number of row scan time periods included in the charge phase of the current frame.

For example, in the drive circuit, the row number of the pixels generally is numbered from 0, and thus, in the above-mentioned formula, if the total row number is 2250, M herein can be equal to 2249, and if the number of the row scan time periods included in the charge phase of the current frame is 70, N herein can be 69, so that the gain value of the row to be compensated is that $A=2249/(2249-69)$.

For example, in some other examples, the step S1011 may also include: determining an identifier corresponding to the sub-pixel to be compensated; and determining the gain value of the sub-pixel to be compensated in the row to be compensated according to the identifier corresponding to the sub-pixel to be compensated.

For example, a corresponding relationship of the identifier corresponding to the sub-pixel to be compensated and the gain value can be calculated in advance and stored, and the gain value is calculated in the same way as the above-mentioned formula.

For example, the identifier corresponding to the sub-pixel to be compensated can be used for identifying the color of the sub-pixel to be compensated, and for example, a red sub-pixel corresponds to an identifier 1, a green sub-pixel corresponds to an identifier 2 and the like. Therefore, the gain value of the sub-pixel to be compensated in the row to be compensated corresponds to the color corresponding to the sub-pixel to be compensated.

For example, the gain values of the sub-pixels to be compensated are determined by charge efficiency of sub-pixels of different colors. The charge efficiency of the sub-pixels of different colors may be the same or may also be different, and thus, the gain values of the sub-pixels of different colors may be the same, or may also be different.

For example, gain values of the red sub-pixel, the green sub-pixel and a white sub-pixel are the same, and a gain value of the read sub-pixel and a gain value of a blue sub-pixel are different. In some examples, N (i.e., the number of the row scan time periods included in the charge phase of the current frame) corresponding to the red sub-pixel, the green sub-pixel and the white sub-pixel can be 70, and N corresponding to the blue sub-pixel can be 60.

The beneficial effects brought by the technical solutions provided by the embodiments of the present disclosure comprise: the write-back voltage of the sub-pixel to be compensated in the row to be compensated is determined according to the data voltage and the gain value of the sub-pixel to be compensated in the row to be compensated in the current frame; then in the compensation write-back phase of the scan time of the blank period of the current frame, the write-back voltage of the sub-pixel to be compensated in the row to be compensated in the current frame is respectively written into the sub-pixel to be compensated in the row to be compensated; and when the current frame is subjected to electrical signal detection (in the charge phase of the scan time of the blank period), the sub-pixel to be compensated may generate the dark line, and thus, after the charge phase is completed, the gained write-back voltage can be written back to the sub-pixel to be compensated to enable the sub-pixel to be compensated to emit light again so as to eliminate the dark line. In the charge phase (time of the electrical signal detection) and time after the charge phase, average brightness of the sub-pixels to be compensated is equivalent to average brightness of the sub-pixels to be compensated when electrical detection is not performed, and thus, human eyes cannot see obvious dark line, so that the dark line is eliminated.

Figure 4:
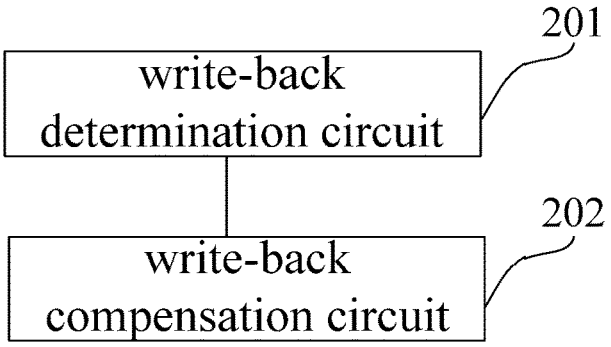
FIG. 4 is a schematic diagram of a compensation apparatus for an OLED provided by an embodiment of the present disclosure.

FIG. 4 is a schematic diagram of a compensation apparatus for an OLED provided by an embodiment of the present disclosure. Referring to FIG. 4, the compensation apparatus comprises: a write-back determination circuit 201 and a write-back compensation circuit 202. The write-back determination circuit 201 is configured to determine a write-back voltage of each sub-pixel to be compensated in a row to be compensated in a current frame according to a data voltage and a gain value of the sub-pixel to be compensated in the row to be compensated in the current frame, for example, the gain value being greater than 1. The write-back compensation circuit 202 is configured to respectively write back the write-back voltage of each sub-pixel to be compensated in the row to be compensated in the current frame correspondingly to the sub-pixel to be compensated in the row to be compensated in scan time of a blank period of the current frame.

For example, the gain value is the set value, i.e., the gain value can be preset.

For example, the colors corresponding to all the sub-pixels to be compensated in the row to be compensated are the same. The gain value of the sub-pixel to be compensated in the row to be compensated corresponds to the color corresponding to the sub-pixel to be compensated.

For example, the display time of the current frame may include a plurality of row scan time periods, the scan time of the blank period includes the last W1 row scan time periods in the plurality of row scan time periods, the last W1 row scan time periods include the charge phase and the compensation write-back phase, and W1 is a positive integer.

For example, the write-back compensation circuit 202 is configured to: in the charge phase, charge a sense line corresponding to each sub-pixel to be compensated in the row to be compensated, the sense line being used for detecting an electrical signal of the sub-pixel to be compensated; and in the compensation write-back phase, calculate a compensation voltage of each sub-pixel to be compensated in the row to be compensated in a next frame adjacent to the current frame according to the detected electrical signal of the sense line.

For example, the write-back compensation circuit 202 is further configured to: in the compensation write-back phase, respectively write back the write-back voltage of each sub-pixel to be compensated in the row to be compensated in the current frame correspondingly to the sub-pixel to be compensated in the row to be compensated.

For example, in the embodiment of the present disclosure, the write-back determination circuit 201 is configured to: acquire the gain value of each sub-pixel to be compensated; and respectively multiply the data voltage of each sub-pixel to be compensated in the current frame by the gain value to obtain the write-back voltage of each sub-pixel to be compensated in the current frame.

For example, in the embodiment of the present disclosure, the gain value is determined by adopting a formula: $A=M/(M-N)$, A represents the gain value of the sub-pixel to be compensated in the row to be compensated, M represents a quantity of the plurality of row scan time periods included in the display time of the current frame, and N represents a quantity of row scan time periods included in the charge phase.

For example, the sub-pixel to be compensated comprises a pixel circuit and a light-emitting component, the pixel circuit comprises a drive transistor, a data writing transistor, a sense transistor and a capacitor. The drive transistor is configured to drive the light-emitting component to emit light; the data writing transistor is configured to write the data voltage into a gate electrode of the drive transistor when the data writing transistor is turned on; the capacitor is configured to store the data voltage and maintain the data voltage at the gate electrode of the drive transistor; and the sense transistor is configured to charge the sense line corresponding to the sub-pixel to be compensated.

For example, a source electrode of the data writing transistor is configured to receive the data voltage, a gate electrode of the data writing transistor is connected to a gate line to receive a first drive signal, and a drain electrode of the data writing transistor is connected with the gate electrode of the drive transistor; a source electrode of the drive transistor is connected with a first power supply end, and a drain electrode of the drive transistor is connected with a first end of the light-emitting component; an end of the capacitor is connected with the gate electrode of the drive transistor, and the other end of the capacitor is connected with the drain electrode of the drive transistor; and a source electrode of the sense transistor is connected with the drain electrode of the drive transistor, a drain electrode of the sense transistor is connected with the sense line corresponding to the sub-pixel to be compensated, and a gate electrode of the sense transistor is configured to receive a second drive signal.

It should be noted that the detailed descriptions of the pixel circuit may be referred to the related description in the embodiments of the above-mentioned compensation method, and are not repeated herein.

For example, in the sub-pixel to be compensated in the row to be compensated, the first drive signal and the second drive signal are the same signal so as to facilitate design of the pixel circuit.

For example, the compensation write-back phase comprises a write-back sub-phase and a re-light-emitting sub-phase. The write-back compensation circuit 202 is configured to: when the charge phase is completed, reset a voltage of the sense line; in the write-back sub-phase, control the data writing transistor of each sub-pixel to be compensated in the row to be compensated to be turned on, and write the write-back voltage into the gate electrode of the drive transistor of each sub-pixel to be compensated in the row to be compensated; and in the re-light-emitting sub-phase, control the data writing transistor of each sub-pixel to be compensated in the row to be compensated to be turned off, and control the sense transistor of each sub-pixel to be compensated in the row to be compensated to be turned off.

It should be noted that, the write-back determination circuit 201 is also used for performing the step S101 in the above-mentioned compensation method, and the write-back compensation circuit 202 is also used for performing the step S102 in the above-mentioned compensation method, and thus, specific functions of the write-back determination circuit 201 and the write-back compensation circuit 202 may be referred to the related description in the embodiments of the above-mentioned compensation method.

For example, in the embodiments of the present disclosure, the write-back determination circuit 201 may be integrated in the drive circuit of the OLED panel, or may also be implemented by adopting an independent integrated circuit chip. The write-back compensation circuit 202 may include a data signal generation circuit, the integrated circuit chip, the sense line and the like in the drive circuit of the OLED panel.

Because the compensation apparatus and the above-mentioned compensation method which are provided by the embodiments of the present disclosure are based on the same inventive concept, and thus, method steps specifically performed by respective circuits in the compensation apparatus may be referred to related portions in the embodiments of the compensation method, and are not repeated herein.

An embodiment of the present disclosure further provides an OLED panel. The OLED panel includes the compensation apparatus according to any one of the above-mentioned embodiments. Because the OLED panel includes the compensation apparatus as shown in FIG. 4, the same technical effects as the compensation apparatus can be achieved, i.e., the dark line of the display panel can be eliminated, and uniformity of display of the display panel is improved.

Figure 5:
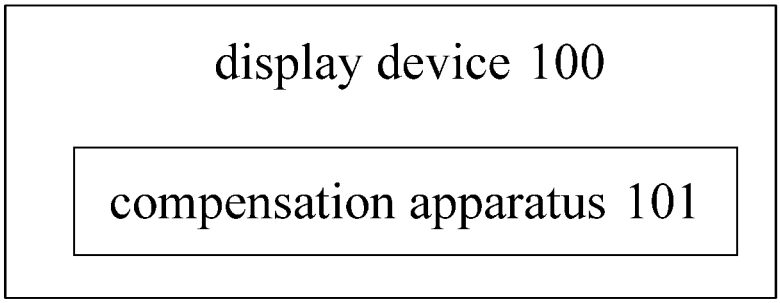
FIG. 5 is a schematic diagram of a display device provided by an embodiment of the present disclosure.

FIG. 5 is a schematic diagram of a display device provided by an embodiment of the present disclosure. An embodiment of the present disclosure further provides a display device. As shown in FIG. 5, the display device 100 includes the OLED panel or compensation apparatus 101 described in any one of the above-mentioned embodiments.

For example, the display device 100 provided by the embodiment of the present disclosure can be a mobile phone, a tablet, a television, a monitor, a notebook computer, a digital photo frame, a navigator, or any products or components having a display function. Because the display device 100 includes the above-mentioned OLED panel or compensation apparatus 101, the same technical effects as the OLED panel or the compensation apparatus 101 can be achieved, i.e., the dark line of the display panel can be eliminated, and uniformity of display of the display panel is improved.

What have been described above are merely some preferred embodiments of the present disclosure. Obviously, various changes and modifications can be made by those skilled in the art to the present disclosure, without departing from the spirits and the scope of the present disclosure. Therefore, so far as these changes and modifications fall within the scope of the claims and their equivalents of the present disclosure, the present disclosure shall also intend to cover such changes and modifications.

What is claimed is:

1. A compensation method for an organic light-emitting display, comprising:

determining a write-back voltage of each sub-pixel to be compensated in a row to be compensated in a current frame according to a data voltage and a gain value of the sub-pixel to be compensated in the row to be compensated in the current frame, the gain value being greater than 1; and respectively writing back the write-back voltage of each sub-pixel to be compensated in the row to be compensated in the current frame correspondingly to the sub-pixel to be compensated in the row to be compensated in a scan time of a blank period of the current frame, wherein a display time of the current frame comprises a plurality of row scan time periods, each row scan time period is a scan time of pixels in one row, a scan time of the blank period comprises last W1 row scan time periods in the plurality of row scan time periods, and the last W1 row scan time periods comprise a charge phase and a compensation write-back phase, wherein W1 is a positive integer, a quantity of row scan time periods included in the charge phase in the last W1 row scan time periods is greater than a quantity of row scan time periods included in the compensation write-back phase in the last W1 row scan time periods, the gain value is determined by adopting a formula: $A=M/(M-N)$, wherein A represents the gain value of the sub-pixel to be compensated in the row to be compensated, M represents a quantity of the plurality of row scan time periods included in the display time of the current frame, and N represents the quantity of row scan time periods included in the charge phase.

2. The compensation method according to claim 1, wherein the compensation method further comprises:

in the charge phase, charging a sense line corresponding to each sub-pixel to be compensated in the row to be compensated, the sense line being used for detecting an electrical signal of the sub-pixel to be compensated; and in the compensation write-back phase, calculating a compensation voltage of each sub-pixel to be compensated in the row to be compensated in a next frame subsequent to the current frame according to the electrical signal detected.

3. The compensation method according to claim 2, further comprising:

in the compensation write-back phase, respectively writing back the write-back voltage of each sub-pixel to be compensated in the row to be compensated in the current frame correspondingly to the sub-pixel to be compensated in the row to be compensated.

4. The compensation method according to claim 2, wherein the determining the write-back voltage of each sub-pixel to be compensated in the row to be compensated in the current frame according to the data voltage and the gain value of the sub-pixel to be compensated in the row to be compensated in the current frame comprises:

acquiring the gain value of each sub-pixel to be compensated; and respectively multiplying a data voltage of each sub-pixel to be compensated in the current frame by the gain value to obtain the write-back voltage of each sub-pixel to be compensated in the current frame.

5. The compensation method according to claim 1, wherein all sub-pixels to be compensated in the row to be compensated work in a same color.

6. The compensation method according to claim 2, wherein the sub-pixel to be compensated comprises a pixel circuit, the pixel circuit comprises a drive transistor, a data writing transistor, and a sense transistor, the compensation write-back phase comprises a write-back sub-phase and a re-light-emitting sub-phase, and the respectively writing back the write-back voltage of each sub-pixel to be compensated in the row to be compensated in the current frame correspondingly to the sub-pixel to be compensated in the row to be compensated comprises:

when the charge phase is completed, resetting a voltage of the sense line;

in the write-back sub-phase, controlling the data writing transistor of each sub-pixel to be compensated in the row to be compensated to be turned on, and writing the write-back voltage into a gate electrode of the drive transistor of each sub-pixel to be compensated in the row to be compensated; and in the re-light-emitting sub-phase, controlling the data writing transistor of each sub-pixel to be compensated in the row to be compensated to be turned off, and controlling the sense transistor of each sub-pixel to be compensated in the row to be compensated to be turned off.

7. The compensation method according to claim 6, wherein, in the sub-pixel to be compensated in the row to be compensated, a drive signal of the data writing transistor and a drive signal of the sense transistor are a same signal.

8. A compensation apparatus for an organic light-emitting display, comprising:

a write-back determination circuit, configured to determine a write-back voltage of each sub-pixel to be compensated in a row to be compensated in a current frame according to a data voltage and a gain value of the sub-pixel to be compensated in the row to be compensated in the current frame, the gain value being greater than 1; and a write-back compensation circuit, configured to respectively write back the write-back voltage of each sub-pixel to be compensated in the row to be compensated in the current frame correspondingly to the sub-pixel to be compensated in the row to be compensated in a scan time of a blank period of the current frame, wherein a display time of the current frame comprises a plurality of row scan time periods, each row scan time period is a scan time of pixels in one row, a scan time of the blank period comprises last W1 row scan time periods in the plurality of row scan time periods, and the last W1 row scan time periods comprise a charge phase and a compensation write-back phase, wherein W1 is a positive integer, a quantity of row scan time periods included in the charge phase in the last W1 row scan time periods is greater than a quantity of row scan time periods included in the compensation write-back phase in the last W1 row scan time periods, the gain value is determined by adopting a formula: $A=M/(M-N)$, wherein A represents the gain value of the sub-pixel to be compensated in the row to be compensated, M represents a quantity of the plurality of row scan time periods included in the display of the current time frame, and N represents the quantity of row scan time periods included in the charge phase.

9. The compensation apparatus according to claim 8, wherein the write-back compensation circuit is configured to:

in the charge phase, charge a sense line corresponding to each sub-pixel to be compensated in the row to be compensated, the sense line being used for detecting an electrical signal of the sub-pixel to be compensated; and in the compensation write-back phase, calculate a compensation voltage of each sub-pixel to be compensated in the row to be compensated in a next frame subsequent to the current frame according to the electrical signal detected.

10. The compensation apparatus according to claim 9, wherein the write-back compensation circuit is further configured to: in the compensation write-back phase, respectively write back the write-back voltage of each sub-pixel to be compensated in the row to be compensated in the current frame correspondingly to the sub-pixel to be compensated in the row to be compensated.

11. The compensation apparatus according to claim 9, wherein the write-back determination circuit is configured to: acquire the gain value of each sub-pixel to be compensated; and respectively multiply a data voltage of each sub-pixel to be compensated in the current frame by the gain value to obtain the write-back voltage of each sub-pixel to be compensated in the current frame.

12. The compensation apparatus according to claim 10, wherein the sub-pixel to be compensated comprises a pixel circuit and a light-emitting component, the pixel circuit comprises a drive transistor, a data writing transistor, a sense transistor, and a capacitor, and the drive transistor is configured to drive the light-emitting component to emit light;

the data writing transistor is configured to write the data voltage into a gate electrode of the drive transistor when the data writing transistor is turned on;

the capacitor is configured to store the data voltage and maintain the data voltage at the gate electrode of the drive transistor; and the sense transistor is configured to charge the sense line corresponding to the sub-pixel to be compensated.

13. The compensation apparatus according to claim 12, wherein the compensation write-back phase comprises a write-back sub-phase and a re-light-emitting sub-phase, and the write-back compensation circuit is configured to:

when the charge phase is completed, reset a voltage of the sense line;

in the write-back sub-phase, control the data writing transistor of each sub-pixel to be compensated in the row to be compensated to be turned on, and write the write-back voltage into the gate electrode of the drive transistor of each sub-pixel to be compensated in the row to be compensated; and in the re-light-emitting sub-phase, control the data writing transistor of each sub-pixel to be compensated in the row to be compensated to be turned off, and control the sense transistor of each sub-pixel to be compensated in the row to be compensated to be turned off.

14. The compensation apparatus according to claim 12, wherein a source electrode of the data writing transistor is configured to receive the data voltage, a gate electrode of the data writing transistor is connected with a gate line to receive a first drive signal, and a drain electrode of the data writing transistor is connected with the gate electrode of the drive transistor;

a source electrode of the drive transistor is connected with a first power supply end, and a drain electrode of the drive transistor is connected with a first end of the light-emitting component;

a first end of the capacitor is connected with the gate electrode of the drive transistor, and a second end of the capacitor is connected with the drain electrode of the drive transistor; and a source electrode of the sense transistor is connected with the drain electrode of the drive transistor, a drain electrode of the sense transistor is connected with the sense line corresponding to the sub-pixel to be compensated, and a gate electrode of the sense transistor is configured to receive a second drive signal.

15. The compensation apparatus according to claim 14, wherein, in the sub-pixel to be compensated in the row to be compensated, the first drive signal and the second drive signal are a same signal.

16. A display device, comprising the compensation apparatus according to claim 8.

17. The compensation method according to claim 5, wherein the gain value of the sub-pixel to be compensated in the row to be compensated corresponds to a color corresponding to the sub-pixel to be compensated.

18. The compensation apparatus according to claim 8, wherein the gain value of the sub-pixel to be compensated in the row to be compensated corresponds to a color corresponding to the sub-pixel to be compensated.

* * * * *